US007714808B2

(12) United States Patent
Paik et al.

(10) Patent No.: US 7,714,808 B2
(45) Date of Patent: May 11, 2010

(54) PLASMA DISPLAY APPARATUS AND DRIVING METHOD THEREOF

(75) Inventors: Dongki Paik, Yongin-si (KR); Jongrae Lim, Anyang-si (KR); Tae Heon Kim, Seoul (KR); Wootae Kim, Yongin-si (KR); Sung Chun Choi, Anyang-si (KR)

(73) Assignee: LG Electronics Inc., Seoul (KR)

( * ) Notice: Subject to any disclaimer, the term of this patent is extended or adjusted under 35 U.S.C. 154(b) by 598 days.

(21) Appl. No.: 11/644,970

(22) Filed: Dec. 26, 2006

(65) Prior Publication Data

US 2008/0150836 A1 Jun. 26, 2008

(51) Int. Cl.
*G09G 3/28* (2006.01)

(52) U.S. Cl. ..... 345/60; 345/68

(58) Field of Classification Search ..... 345/60–68; 315/169.1–169.4

See application file for complete search history.

(56) References Cited

U.S. PATENT DOCUMENTS

| | | | | |
|---|---|---|---|---|
| 7,580,050 | B2 * | 8/2009 | Kim et al. | 346/60 |
| 2002/0050794 | A1 | 5/2002 | Ishizuka | 315/169.3 |
| 2003/0174102 | A1 * | 9/2003 | Jeong | 345/60 |
| 2004/0233128 | A1 * | 11/2004 | Choi et al. | 345/60 |
| 2005/0030259 | A1 * | 2/2005 | Kim et al. | 345/60 |
| 2005/0073485 | A1 * | 4/2005 | Kim et al. | 345/63 |
| 2006/0103598 | A1 * | 5/2006 | Woo et al. | 345/63 |
| 2006/0164343 | A1 | 7/2006 | Sasaki et al. | 345/67 |

FOREIGN PATENT DOCUMENTS

| | | | |
|---|---|---|---|
| EP | 1 357 535 | A2 | 10/2003 |
| KR | 10-2004-0004210 | A | 1/2004 |

OTHER PUBLICATIONS

Cho, Byung-Gwo, et al.; "26:3 A New Driving Waveform for Improving Luminous Efficiency in AC PDP with Large Sustain Gap Under High Xe Content"; 2005 SID International Symposium Digest of Technical Papers; Boston, Massachusetts; San Jose, California; May 24-27, 2005; pp. 1138-1141 (XP 001244333).

(Continued)

*Primary Examiner*—Nitin Patel
(74) *Attorney, Agent, or Firm*—KED & Associates, LLP

(57) ABSTRACT

A plasma display apparatus comprises a scan electrode and a sustain electrode; a data electrode for intersecting the scan electrode and the sustain electrode; and a pulse controller for controlling to apply a pulse having an opposite phase to the scan electrode and the sustain electrode during a reset period and apply a negative sustain pulse to the scan electrode and the sustain electrode during a sustain period, wherein a distance between the scan electrode and the sustain electrode is longer than that between the sustain electrode and the data electrode. Therefore, a surface discharge mode can be used even when applying negative pulses to the sustain electrode in a reset period, and a size and cost of a plasma display apparatus can be reduced by applying a negative pulse of the same magnitude as a sustain voltage without a separate negative voltage source.

16 Claims, 6 Drawing Sheets

OTHER PUBLICATIONS

Sang, Dae Park, et al.; "P-69: Luminance and Luminous Efficiency of AC PDP with Coplanar Long-Gap and High Xe Content Gas-Mixture"; 2004 SID International Symposium; Seattle, Washington; San Jose, California; May 25-27, 2004; pp. 506-509 (XP 007012106).

Kim, Hyun et al.; "Firing and Sustaining Discharge Characteristics in Alternating Current Microdischarge Cell with Three Electrodes"; IEEE Transactions on Plasma Science, IEEE Service Center; Piscataway, NJ; Apr. 2004; pp. 488-492 (XP011114572).

European Search Report dated May 4, 2007.

Korean Office Action dated Sep. 25, 2006.

* cited by examiner

PLASMA DISPLAY APPARATUS AND DRIVING METHOD THEREOF

BACKGROUND

1. Field

This document relates to a plasma display apparatus and a driving method thereof.

2. Related Art

In general, a plasma display panel (PDP) applies a reset pulse for initializing a discharge cell, an address pulse for selecting a cell to be discharged, and a sustain pulse for sustaining a discharge of a discharge cell to each electrode by a predetermined number of times according to a gray level value of each subfield and allows a phosphor to emit light by a gas discharge generating through applying of the pulses. The PDP repeats resetting, addressing, and sustaining in each subfield constituting a frame, and it is required to apply an erase pulse for removing wall charges remaining in each electrode side before the each subfield starts in order to improve PDP driving characteristics.

FIG. 1 is a view illustrating a structure of a general PDP.

As shown in FIG. 1, the PDP comprises a front panel 100 and a rear panel 110 that are disposed apart a predetermined distance and coupled in parallel to each other. The front panel 100 is arranged with a plurality of sustain electrode pairs in which a scan electrode 102 and a sustain electrode 103 are formed in pairs on a front glass 101, which is a display surface for displaying an image. The rear panel 110 has a plurality of address electrodes 113 arranged to intersect the plurality of sustain electrode pairs on a rear glass 111 constituting a rear surface.

The front panel 100 comprises pairs of the scan electrode 102 and the sustain electrode 103, which have a transparent electrode (a) made of transparent indium-tin-oxide (ITO) and a bus electrode (b) made of metal, for performing a mutual discharge in one discharge cell and sustaining emission of the cell. The scan electrode 102 and the sustain electrode 103 are covered with at least one upper dielectric layer 104 that limits a discharge current and that insulates each electrode pair. A protective layer 105 deposited with magnesium oxide (MgO) is formed on the upper dielectric layer 104 to facilitate a discharge condition.

The rear panel 110 comprises stripe-type (or well-type) barrier ribs 112, which are arranged in parallel, for forming a plurality of discharge spaces i.e., discharge cells. A plurality of address electrodes 113 for generating vacuum ultraviolet rays by performing an address discharge is arranged in parallel to the barrier ribs 112. Red (R), green (G) and blue (B) phosphors 114 that emit visible rays for displaying an image at an address discharge are coated over an upper surface of the rear panel 110. A lower dielectric layer 115 for protecting the address electrode 113 is formed between the address electrode 113 and the phosphor 114.

A method of representing an image gray level in the PDP is shown in FIG. 2.

FIG. 2 is a diagram illustrating a method of representing an image gray level of a general PDP.

As shown in FIG. 2, in the method of representing an image gray level of a conventional PDP, a frame is divided into several subfields having different number of times of light emitting and each subfield is again divided into a reset period (RPD) for initializing all cells, an address period (APD) for selecting a cell to be discharged, and a sustain period (SPD) for representing a gray level depending on the number of times of discharges. For example, when an image is represented with 256 gray levels, a frame period (16.67 ms) corresponding to 1/60 second is divided into eight subfields (SF1 to SF8), as shown in FIG. 2 and each of the eight subfields (SF1 to SF8) is again divided into the reset period, the address period, and the sustain period.

The duration of the reset period in a subfield is equal to the duration of the reset periods in the remaining subfields. The duration of the address period in a subfield is equal to the duration of the address periods in the remaining subfields. An address discharge for selecting a cell to be discharged is generated by a voltage difference between an address electrode and a transparent electrode, which is a scan electrode. The sustain period increases in a ratio of $2^n$ (n=0, 1, 2, 3, 4, 5, 6, 7) in each subfield. Since the sustain period becomes different in each subfield, a gray level of an image is expressed by adjusting a sustain period of each subfield, i.e., the number of times of a sustain discharge. A driving waveform according to a driving method of the PDP is shown in FIG. 3.

FIG. 3 is a diagram illustrating a driving waveform according to a driving method of a conventional PDP.

As shown in FIG. 3, the PDP is divided into a reset period for initializing all cells, an address period for selecting a cell to be discharged, and a sustain period for sustaining a discharge of the selected cell for driving.

In a setup period (SU) of the reset period, ramp-up waveforms (ramp-up) are simultaneously applied to all scan electrodes (Y). A discharge is generated within discharge cells of an entire screen by the ramp-up waveform. The setup discharge causes positive wall charges to be accumulated on address electrodes (X) and sustain electrodes (Z) and negative wall charges to be accumulated on scan electrodes (Y). In a setdown period (SD) of the reset period, after the ramp-up waveform is applied, a ramp-down waveform (ramp-down) that falls from a positive voltage lower than a peak voltage of the ramp-up waveform up to a ground (GND) voltage or a negative voltage level is applied, whereby a weak erase discharge is generated within the discharge cells and thus some of excessively formed wall charges is erased. Wall charges sufficient for a stable address discharge due to the setdown discharge are uniformly remained within the discharge cells.

In the address period, negative scan pulses (Scan) are sequentially applied to the scan electrodes (Y) and positive data pulses (data) are applied to the address electrodes (X) in synchronization with the scan pulse. As a voltage difference between the scan pulses and the data pulses is added to a wall voltage by wall charges generated in the initialization period, an address discharge is generated within the discharge cells to which the data pulse is applied. Wall charges sufficient for a discharge when a sustain voltage is applied are generated within discharge cells selected by an address discharge. The sustain electrodes (Z) are supplied with a positive DC voltage (Zdc) so that an erroneous discharge is not generated between the sustain electrode (Z) and the scan electrode (Y) by reducing the voltage difference between the sustain electrode (Z) and the scan electrode (Y) during the setdown period and the address period.

In the sustain period, sustain pulses (Sus) are alternately applied to the scan electrodes (Y) and the sustain electrodes (Z). In a discharge cell selected by an address discharge, a sustain discharge, i.e., a display discharge is generated between the scan electrodes (Y) and the sustain electrodes (Z) whenever each sustain pulse is applied as the sustain pulse and the wall voltage within the discharge cell are added.

After the sustain discharge is completed, an erase ramp waveform (Ramp-ers) having a narrow pulse width and a low voltage level is applied to the sustain electrodes (Z) to erase wall charges remaining within the discharge cells of the entire screen.

As described above, as the plasma display apparatus alternately applies positive sustain pulses (sus) to the scan electrode (Y) side and the sustain electrode (Z) side during a sustain period, positive ions are stacked to the address electrode (X) side having a relatively low potential difference. As positive ions relatively heavier than electrons apply ion bombardment to a phosphor layer (114 of FIG. 1) of a rear panel in which address electrodes (X) are formed, a lifetime of the plasma display apparatus is shortened.

Accordingly, as shown in FIG. 4, recently, by allowing the sustain pulses (sus) to have a negative voltage level, a negative sustain type driving in which electrons are stacked in a rear panel in which the scan electrode (Y) and the sustain electrode (Z) are formed, is performed.

FIG. 4 is a diagram illustrating a driving waveform according to a negative sustain driving method of a conventional PDP.

As shown in FIG. 4, a negative sustain pulse (−sus) is alternately applied to the scan electrode (Y) and the sustain electrode (Z) during a sustain period.

Accordingly, as described above, electrons are relatively stacked by the negative sustain pulses (−sus) in the rear panel 110 in which the phosphor layer 114 is formed, whereby ion bombardment applied to the phosphor layer 114 is decreased. However, as the ion bombardment increases in the magnesium oxide (MgO) layer 105 formed in the front panel 100 in a process in which positive ions are stacked, a secondary electron generating rate improves.

That is, by increasing a secondary electron generating amount while preventing damage of the phosphor layer 114, a lifetime of a plasma display apparatus can be extended and a discharge firing voltage can be lowered.

The negative sustain pulse (−sus) can be applied to a long gap structure, which is a new electrode structure.

A conventional interval between electrodes was about 60 to 80 um, but a structure of increasing a light amount passing through an interval between electrodes by widening an interval between electrodes to more than 150 um is referred to as a long gap structure. According to the long gap structure, as a light amount emitted from a phosphor increases, light emitting efficiency can be improved.

In order to represent a long gap structure, the long gap structure is generally formed by reducing a conventional electrode area, i.e., an ITO area. According to the long gap structure, when a discharge is generated between the scan electrode and the sustain electrode, an opposed discharge is generated if a sustain voltage is set to a ground voltage.

The opposed discharge is a discharge between the scan electrode and the data electrode. That is, in the long gap structure, a discharge is generated due to a voltage difference between the scan electrode and the data electrode earlier than a discharge between the scan electrode and the sustain electrode when a voltage difference is generated between the sustain electrode set to a ground voltage and the scan electrode. As describe above, the long gap structure is driven on the assumption of generating of an opposed discharge. Accordingly, a driving method different from a driving method in a conventional surface discharge mode is required.

SUMMARY

In an aspect, a plasma display apparatus comprising: a scan electrode and a sustain electrode; a data electrode for intersecting the scan electrode and the sustain electrode; and a pulse controller for controlling to apply a pulse having an opposite phase to the scan electrode and the sustain electrode during a reset period and apply a negative sustain pulse to the scan electrode and the sustain electrode during a sustain period, wherein a distance between the scan electrode and the sustain electrode is longer than that between the sustain electrode and the data electrode.

A pulse applied to the scan electrode during the reset period may be a ramp-up waveform.

A magnitude of a voltage of the ramp-up waveform may be greater than that of a voltage of a pulse applied to the sustain electrode during the reset period.

During the reset period, a positive ramp waveform may be applied to the scan electrode and a negative pulse may be applied to the sustain electrode and a magnitude of a voltage of the negative pulse may be substantially the same as that of a voltage of the negative sustain pulse.

A distance between the scan electrode and the sustain electrode may be 100 um to 400 um.

A distance between the scan electrode and the sustain electrode may be 150 um to 350 um.

A distance between the scan electrode and the sustain electrode may be a distance between a transparent electrode of the scan electrode and a transparent electrode of the sustain electrode.

The negative pulse may be supplied from the same voltage source as that of the negative sustain voltage.

In another aspect, a driving method of a plasma display apparatus comprising a scan electrode, a sustain electrode, and a data electrode intersecting the scan electrode and the sustain electrode, comprising: applying a pulse having an opposite phase to the scan electrode and the sustain electrode during a reset period; and applying a negative sustain pulse to the scan electrode and the sustain electrode during a sustain period, wherein a distance between the scan electrode and the sustain electrode is longer than that between the scan electrode or the sustain electrode and the data electrode.

A pulse applied to the scan electrode during the reset period may be a ramp-up waveform.

A magnitude of a voltage of the ramp-up waveform may be greater than that of a voltage of a pulse applied to the sustain electrode during the reset period.

During the reset period, a positive ramp waveform may be applied to the scan electrode and a negative pulse may be applied to the sustain electrode and a magnitude of a voltage of the negative pulse may be substantially the same as that of a voltage of the negative sustain pulse.

A distance between the scan electrode and the sustain electrode may be 100 um to 400 um.

A distance between the scan electrode and the sustain electrode may be 150 um to 350 um.

A distance between the scan electrode and the sustain electrode may be a distance between a transparent electrode of the scan electrode and a transparent electrode of the sustain electrode.

The negative pulse may be supplied from the same voltage source as that of the negative sustain voltage.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION

Specific embodiments of the present invention will be described in a more detailed manner with reference to the drawings.

Figure 1:
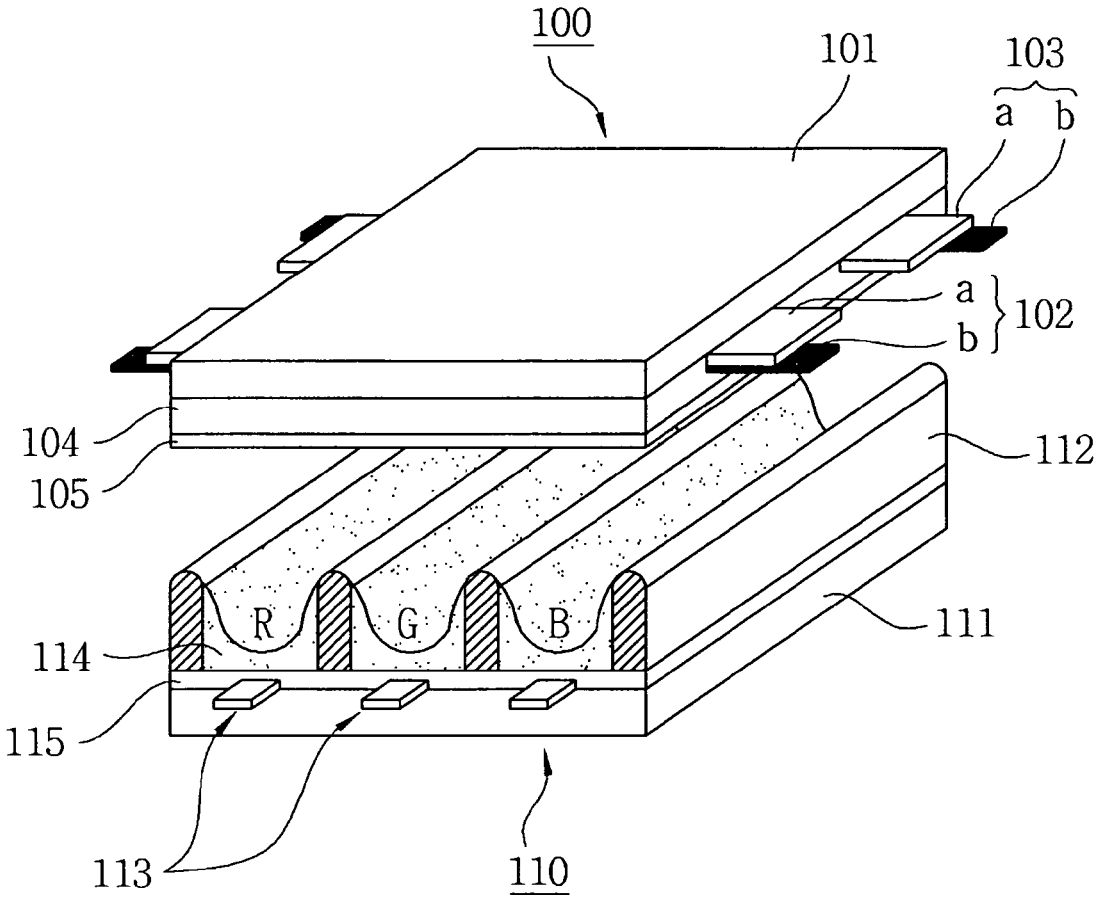
FIG. 1 RELATED ART
FIG. 1 is a view illustrating a structure of a general PDP.
Figure 2:
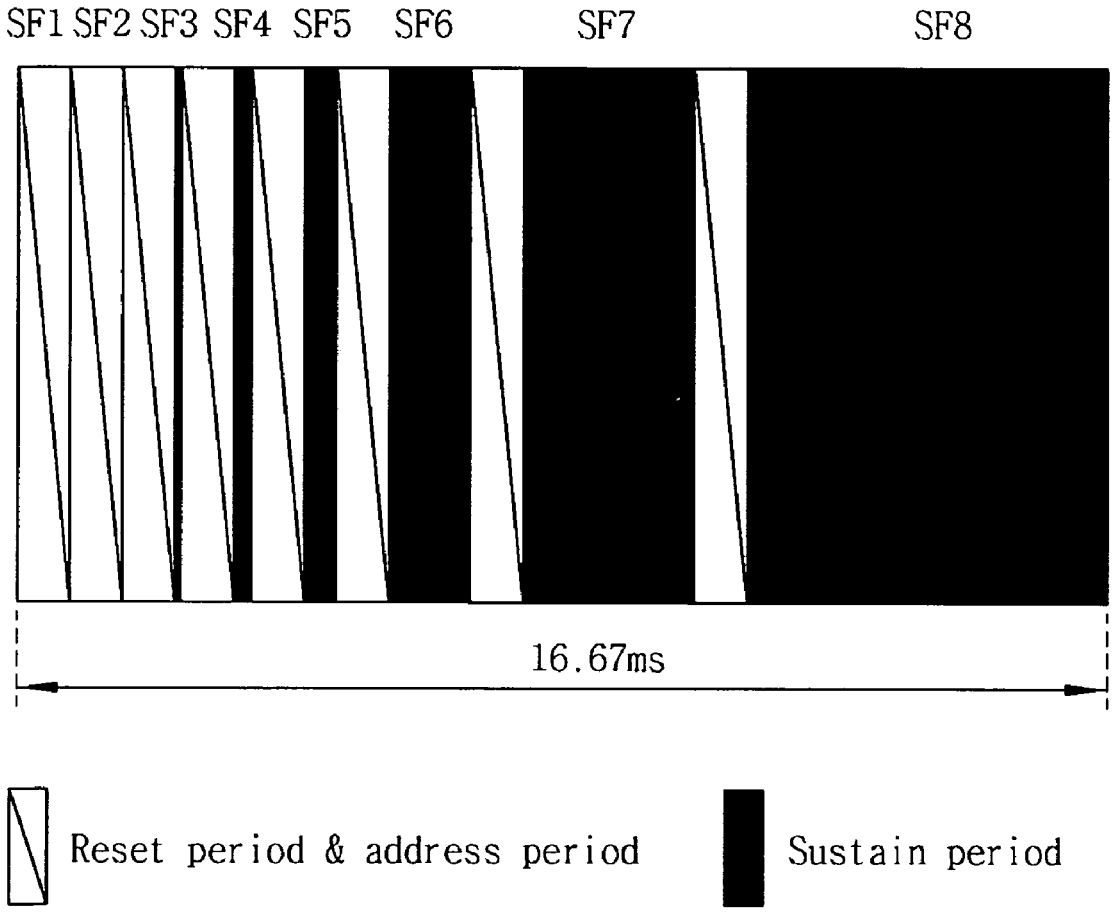
FIG. 2 RELATED ART
FIG. 2 is a diagram illustrating a method of representing an image gray level of a general PDP.
Figure 3:
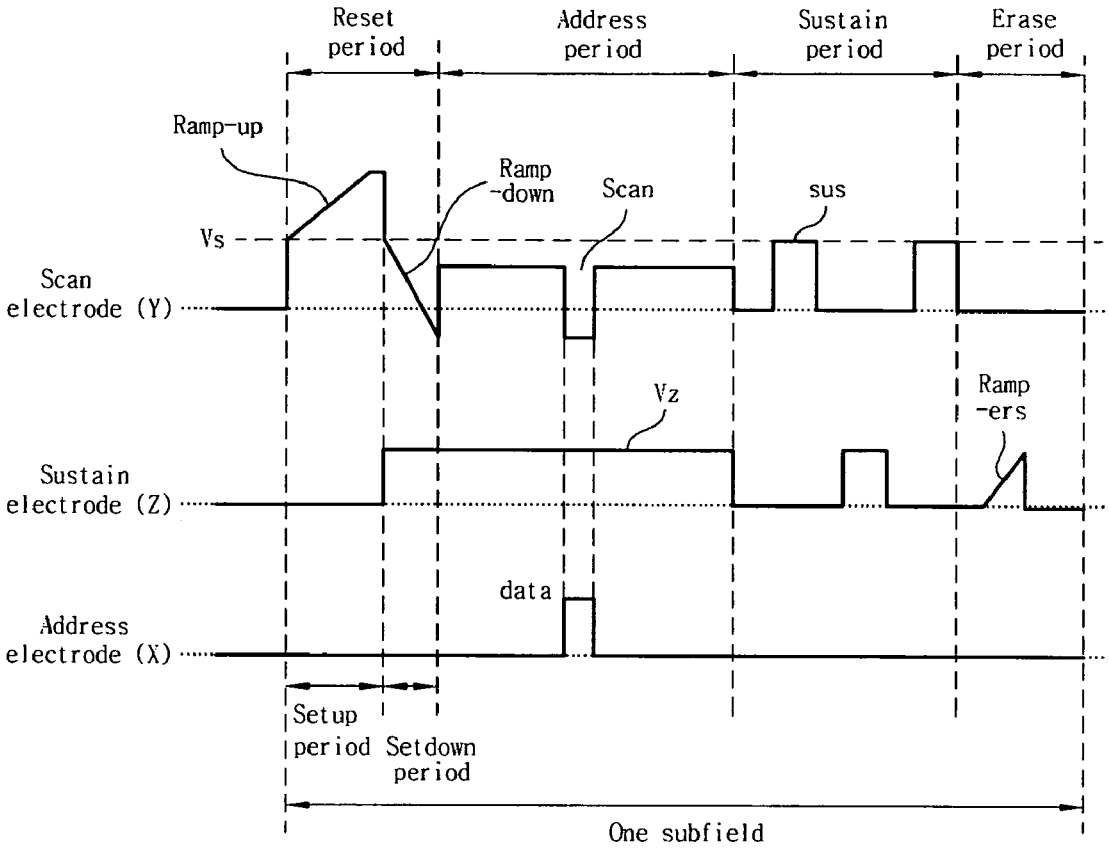
FIG. 3 RELATED ART
FIG. 3 is a diagram illustrating a driving waveform according to a driving method of a conventional PDP.
Figure 4:
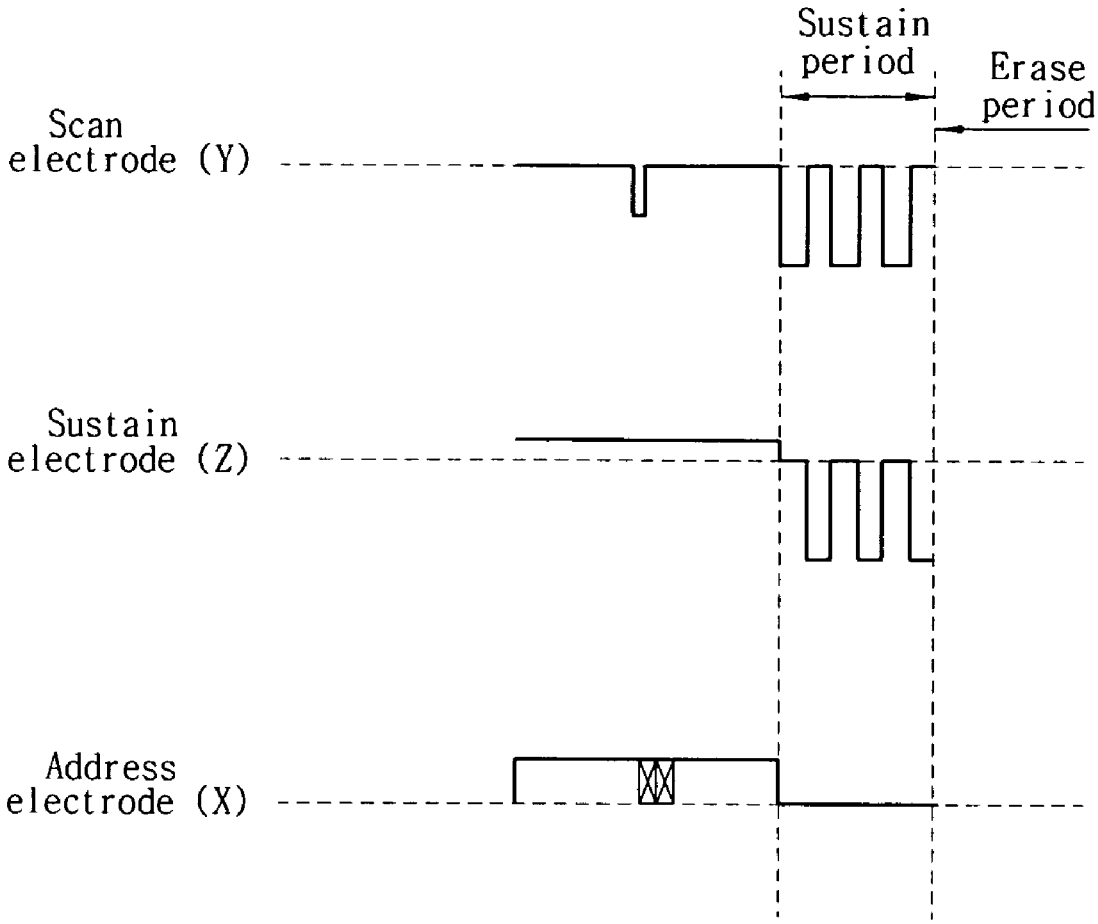
FIG. 4 RELATED ART
FIG. 4 is a diagram illustrating a driving waveform according to a negative sustain driving method of a conventional PDP.
Figure 5:
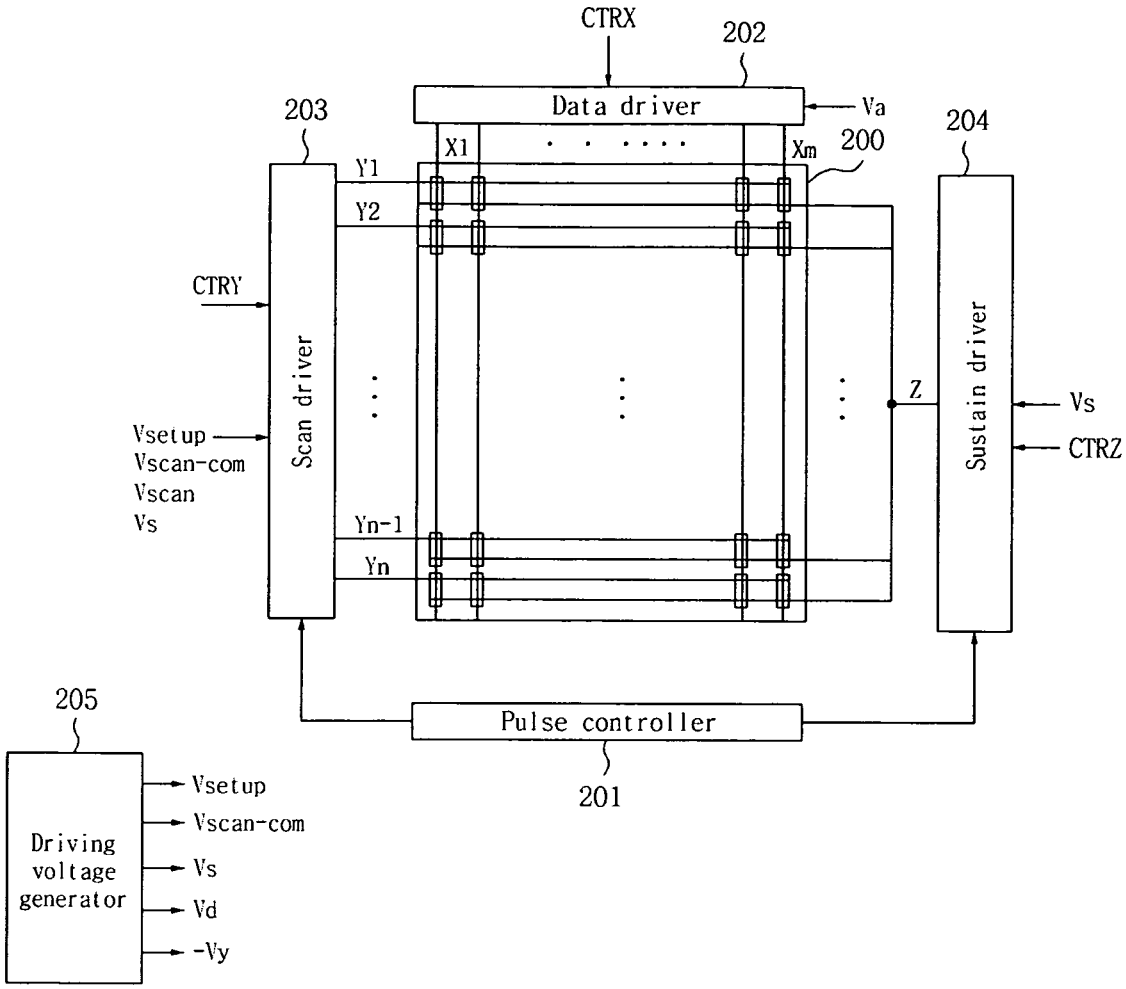
FIG. 5 is a diagram illustrating a plasma display apparatus in this document.

FIG. 5 is a diagram illustrating a plasma display apparatus in this document.

As shown in FIG. 5, the plasma display apparatus comprises a PDP 200 in which driving pulses are applied to address electrodes (X1 to Xm), scan electrodes (Y1 to Yn), and sustain electrodes (Z) in a reset period, an address period, and a sustain period and that expresses an image consisting of a frame by at least one subfield combination, a data driver 202 for supplying data to the address electrodes (X1 to Xm) formed in the PDP 200, a scan driver 203 for driving the scan electrodes (Y1 to Yn), a sustain driver 204 for driving the sustain electrodes (Z) that are a common electrode, a pulse controller 201 for controlling the supply of a reset pulse in a reset period, controlling the supply of a scan pulse in an address period, and controlling the supply of a sustain pulse in a sustain period by controlling the scan driver 203 and the sustain driver 204 when driving the PDP 200, and a driving voltage generator 205 for supplying a necessary driving voltage to each driver 202, 203, and 204.

In the data driver 202, after reverse gamma correction and error diffusion are performed by a reverse gamma correction circuit and an error diffusion circuit that are not shown, mapped data are supplied to each subfield by a subfield mapping circuit. The data driver 202 samples and latches data in response to a data timing control signal (CTRX) from a timing controller (not shown) and then supplies the data to the address electrodes (X1 to Xm). Further, the data driver 202 supplies erase pulses to the address electrodes (X1 to Xm) during an erase period.

The scan driver 203 supplies the reset pulses to the scan electrodes (Y1 to Yn) during a reset period and supplies the scan pulses to the scan electrodes (Y1 to Yn) during an address period under the control of the pulse controller 201 and supplies negative sustain pulses (−sus) to the scan electrodes (Y1 to Yn) during a sustain period and supplies the erase pulses to the scan electrodes (Y1 to Yn) during an erase period under the control of the pulse controller 201.

The sustain driver 204 supplies a predetermined magnitude of bios voltage to the sustain electrodes (Z) during an address period under the control of the pulse controller 201, supplies the negative sustain pulse (−sus) to the sustain electrodes (Z) by alternately operating with the scan driver 203 during the sustain period, and supplies the erase pulse to the sustain electrodes (Z) during an erase period.

The pulse controller 201 supplies a predetermined control signal for controlling an operation timing and synchronization of the scan driver 203, the sustain driver 204, and the data driver 202 in a reset period, an address period, a sustain period, and an erase period to the drivers 202, 203, and 204.

Particularly, unlike the related art, the pulse controller 201 of this document enables to use a surface discharge mode by controlling to apply a pulse having an opposite phase to the scan electrode and the sustain electrode in the reset period.

The data control signal (CTRX) comprises a switch control signal for controlling an on/off time of a sampling clock for sampling data, a latch control signal, an energy recovery circuit, and a driving switch element. The scan control signal (CTRY) comprises a switch control signal for controlling an on/off time of a driving switch element (not shown) and an energy recovery circuit (not shown) within the scan driver 203, and the sustain control signal (CTRZ) comprises a switch control signal for controlling an on/off time of a driving switch element and an energy recovery circuit within the sustain driver 204.

The driving voltage generator 205 generates a setup voltage (Vsetup), a scan common voltage (Vscan-com), a scan voltage (−Vy), ° a sustain voltage (Vs), a data voltage (Vd), etc. The driving voltages can change depending on a composition of a discharge gas or a structure of a discharge cell.

An operation of the plasma display apparatus in shown FIG. 5 becomes apparent by the following driving method.

Figure 6:
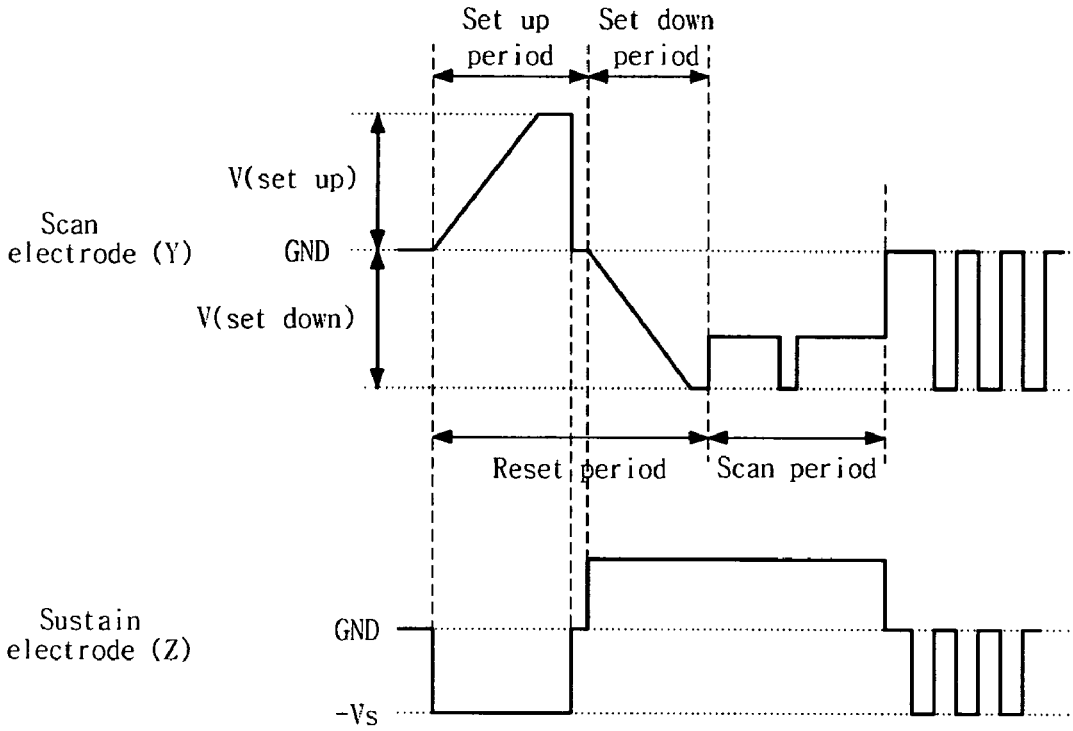
FIG. 6 is a diagram illustrating a driving waveform according to a negative sustain driving method of a plasma display apparatus in this document.

FIG. 6 is a diagram illustrating a driving waveform according to a negative sustain driving method of a plasma display apparatus in this document.

As shown in FIG. 6, a pulse having an opposite phase is applied to the scan electrode and the sustain electrode during a reset period and a negative sustain pulse is applied to the scan electrode and the sustain electrode during a sustain period.

Here, a pulse applied to the scan electrode during the reset period may be a ramp-up waveform. For example, a positive ramp-up waveform may be applied to the scan electrode and a negative pulse may be applied to the sustain electrode. A magnitude of a voltage of the negative pulse may be substantially the same as that of a voltage of the negative sustain pulse. Further, the negative pulse may be supplied from the same voltage source as that of the negative sustain voltage.

Further, it is possible to generate a surface discharge by applying a negative pulse to the scan electrode and a positive pulse to the sustain electrode during the reset period. A magnitude of a voltage of the negative pulse may be substantially the same as that of a voltage of the negative sustain pulse.

In this document, discharge characteristics can be improved using a surface discharge mode. In a long gap structure, when sustaining a sustain electrode in a ground (GND) state during a reset period, an opposed discharge is generated between the scan electrode and the data electrode having an interval relatively smaller than that between the scan electrode and the sustain electrode.

After an opposed discharge is generated, in order to generate again a surface discharge in the scan electrode and the sustain electrode, a proper discharge voltage should be applied according to an amount of wall charges stacked after an opposed discharge.

In this document, the same pulse as a pulse using at a surface discharge is applied to the scan electrode, and a negative bias voltage the same magnitude as a sustain voltage applied for a sustain discharge is applied to the sustain electrode. That is, in this document, resetting is performed using a surface discharge, not an opposed discharge and as a voltage source, a voltage source having the same magnitude as a negative sustain pulse is used. Accordingly, a separate voltage source is not required and thus a cost and size of a plasma display apparatus can be reduced.

In this document, a reset discharge of a surface discharge mode can be effectively performed in a long gap structure in which a distance between the scan electrode and the sustain electrode is longer than a distance between the scan electrode or the sustain electrode and the data electrode. A distance between the scan electrode and the sustain electrode may be 100 um to 400 um. Further, discharge efficiency can be increased in a long gap structure in which a distance between the scan electrode and the sustain electrode is adjusted to 150 um to 350 um. Here, a distance between the scan electrode and the sustain electrode may be defined as a distance between a transparent electrode of the scan electrode and a transparent electrode of the sustain electrode.

In this document, when a negative sustain pulse is applied to the sustain electrode in a setup period of a reset period, a reset pulse for a surface discharge can be applied to the scan electrode. That is, in the setup period of the reset period, a negative sustain pulse is applied to the sustain electrode while a reset pulse of a ramp-up waveform is applied to the scan electrode. Accordingly, a voltage difference is further increased between the scan electrode and the sustain electrode.

In this document, in a setdown period, a reset pulse of a ramp-down waveform is applied to the scan electrode and a positive sustain pulse is applied to the sustain electrode.

In other words, in the setup period of the reset period, a ramp-up waveform is applied and in a setdown period, a ramp-down waveform is applied, to the scan electrode and in a setup period, a negative sustain pulse is applied and in a setdown period, a positive sustain pulse is applied, to the sustain electrode.

As described above, in the setup period of the reset period, abrupt polarity reversal is generated between the scan electrode and the sustain electrode, so that a discharge can be easily generated.

As described above, in this document, when a ramp-up waveform is applied to the scan electrode in the reset period, a magnitude of a negative voltage applied to the sustain electrode is set to be equal to that of a sustain voltage (−Z bias).

As a negative sustain pulse having the same size as that of the negative sustain pulse applied to the scan electrode and the sustain electrode in a sustain period is applied to the sustain electrode in a reset period, a plasma display apparatus can be driven without a separate negative voltage source.

In this document, similarly to a surface discharge, driving pulses can be applied to the sustain electrode in a reset period, and the same voltage source is used in the scan electrode and the sustain electrode. Accordingly, a plasma display apparatus can be driven by applying a negative pulse of the same magnitude as a sustain voltage without a separate negative voltage source, thereby a size and cost thereof can be reduced.

As described above, in this document, a surface discharge mode can be used even when applying negative pulses to the sustain electrode during a setup period of a reset period, and a size and cost of a plasma display apparatus can be reduced by applying a negative pulse of the same magnitude as a sustain voltage without a separate negative voltage source.

The invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

What is claimed is:

1. A plasma display apparatus comprising:

a scan electrode and a sustain electrode;

a data electrode for intersecting the scan electrode and the sustain electrode; and a pulse controller for controlling to apply a pulse having an opposite phase to the scan electrode and the sustain electrode during a reset period and apply a negative sustain pulse to the scan electrode and the sustain electrode during a sustain period, wherein a distance between the scan electrode and the sustain electrode is longer than that between the sustain electrode and the data electrode.

2. The plasma display apparatus of claim 1, wherein a pulse applied to the scan electrode during the reset period is a ramp-up waveform.

3. The plasma display apparatus of claim 2, wherein a magnitude of a voltage of the ramp-up waveform is greater than that of a voltage of a pulse applied to the sustain electrode during the reset period.

4. The plasma display apparatus of claim 2, wherein during the reset period, a positive ramp waveform is applied to the scan electrode and a negative pulse is applied to the sustain electrode, and a magnitude of a voltage of the negative pulse is substantially the same as that of a voltage of the negative sustain pulse.

5. The plasma display apparatus of claim 1, wherein a distance between the scan electrode and the sustain electrode is 100 um to 400 um.

6. The plasma display apparatus of claim 5, wherein a distance between the scan electrode and the sustain electrode is 150 um to 350 um.

7. The plasma display apparatus of claim 1, wherein a distance between the scan electrode and the sustain electrode is a distance between a transparent electrode of the scan electrode and a transparent electrode of the sustain electrode.

8. The plasma display apparatus of claim 4, wherein the negative pulse is supplied from the same voltage source as that of the negative sustain voltage.

9. A driving method of a plasma display apparatus comprising a scan electrode, a sustain electrode, and a data electrode intersecting the scan electrode and the sustain electrode, comprising:

applying a pulse having an opposite phase to the scan electrode and the sustain electrode during a reset period; and applying a negative sustain pulse to the scan electrode and the sustain electrode during a sustain period, wherein a distance between the scan electrode and the sustain electrode is longer than that between the san electrode or the sustain electrode and the data electrode.

10. The driving method of claim 9, wherein a pulse applied to the scan electrode during the reset period is a ramp-up waveform.

11. The driving method of claim 10, wherein a magnitude of a voltage of the ramp-up waveform is greater than that of a voltage of a pulse applied to the sustain electrode during the reset period.

12. The driving method of claim 10, wherein during the reset period, a positive ramp waveform is applied to the scan electrode and a negative pulse is applied to the sustain electrode, and a magnitude of a voltage of the negative pulse is substantially the same as that of a voltage of the negative sustain pulse.

13. The driving method of claim 9, wherein a distance between the scan electrode and the sustain electrode is 100 um to 400 um.

14. The driving method of claim 13, wherein a distance between the scan electrode and the sustain electrode is 150 um to 350 um.

15. The driving method of claim 9, wherein a distance between the scan electrode and the sustain electrode is a distance between a transparent electrode of the scan electrode and a transparent electrode of the sustain electrode.

16. The driving method of claim 12, wherein the negative pulse is supplied from the same voltage source as that of the negative sustain voltage.

* * * * *